US007500283B2

(12) United States Patent
Lee et al.

(10) Patent No.: US 7,500,283 B2
(45) Date of Patent: Mar. 10, 2009

(54) VACUUM CLEANER PROVIDED WITH A COVER LOCKING/RELEASING STRUCTURE AND A COVER HINGE-COUPLING STRUCTURE

(75) Inventors: Nam Ho Lee, Seoul (KR); Jae Duck Lee, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 711 days.

(21) Appl. No.: 11/012,280

(22) Filed: Dec. 16, 2004

(65) Prior Publication Data

US 2005/0138758 A1 Jun. 30, 2005

(30) Foreign Application Priority Data

Dec. 24, 2003 (KR) ..... 10-2003-0096559
Dec. 24, 2003 (KR) ..... 10-2003-0096560

(51) Int. Cl.
*A47L 5/00* (2006.01)

(52) U.S. Cl. ..... 15/327.2; 15/352

(58) Field of Classification Search ..... 15/327.2, 15/327.7, 347, 352
See application file for complete search history.

(56) References Cited

U.S. PATENT DOCUMENTS

| | | | | |
|---|---|---|---|---|
| 2,605,927 | A * | 8/1952 | Segesman | 220/324 |
| 3,170,184 | A * | 2/1965 | Jepson et al. | 15/323 |
| 3,812,659 | A | 5/1974 | Westergren et al. | |
| 5,699,585 | A * | 12/1997 | Tomooka et al. | 15/327.2 |
| 6,901,937 | B2 | 6/2005 | Sebban | 132/301 |

FOREIGN PATENT DOCUMENTS

| | | |
|---|---|---|
| GB | 1215512 | 12/1970 |
| JP | S62-37598 | 3/1987 |
| JP | 1988-046122 | 2/1988 |
| JP | 6-154130 | 6/1994 |
| JP | 2000-185601 | 7/2000 |
| JP | 2004-515259 | 5/2004 |

* cited by examiner

*Primary Examiner*—David B Thomas
(74) *Attorney, Agent, or Firm*—Bacon & Thomas, PLLC

(57) ABSTRACT

A vacuum cleaner includes a suction inlet provided at a main body and a cover hinge-coupled to the main body to cover a dust collection chamber included in the main body. A locking unit is disposed around the suction inlet in order to releasably lock the cover. Further, the vacuum cleaner may include a pivot link for rotatably connecting the cover and the main body. With the pivot link, the cover and the main body are rotatable about two different hinge axes.

1 Claim, 6 Drawing Sheets

VACUUM CLEANER PROVIDED WITH A COVER LOCKING/RELEASING STRUCTURE AND A COVER HINGE-COUPLING STRUCTURE

FIELD OF THE INVENTION

The present invention relates to a vacuum cleaner; and, more particularly, to a cover locking/releasing structure and a cover hinge-coupling structure of a vacuum cleaner wherein a suction inlet is formed at a main body thereof.

BACKGROUND OF THE INVENTION

In general, a vacuum cleaner suctions dust particles on a floor by using a suction force of a fan rotated by a motor installed inside the vacuum cleaner, entraps the dust particles in a dust bag disposed in front of the fan while releasing dust-free air to the outside of the vacuum cleaner.

FIG. 1 shows a conventional vacuum cleaner including a main body 110 and a cover 120 openably attached to the main body 110.

The cover 120 is hinge-coupled to an upper portion of the main body 100, and an air suction tube 130 is connected to the cover 120.

Further, the main body 110 of the vacuum cleaner includes a motor chamber (not shown) accommodating therein a driving motor (not shown) and a dust chamber 114 for accommodating therein, e.g., a dust bag 150 or a cyclonic dust collection device for collecting dust particles contained in air suctioned through the air inlet tube 130.

When the dust bag 114 is filled with dust particles, it should be replaced or emptied. For the purpose, the cover 120 covering the dust chamber 114 is opened approximately upright, as shown in FIG. 1, and the dust bag 150 is removed from the dust chamber 114.

However, in the conventional vacuum cleaner, since the air inlet tube 130 is connected to a suction inlet provided in the cover 120, a connection structure of the cover 120 and the main body 110 becomes complicated due to wirings for connecting electrical components such as a switch provided at the air inlet tube 130 to the main body 110.

Furthermore, when a user attempts to remove the dust bag 150 from the dust chamber 114 with his hands off the cover 120 after the cover 120 is opened as shown in FIG. 1, the cover 120 is often closed due to its weight, which causes an inconvenience to the user. Moreover, in case the user opens the cover 120 with an excessively great force, the cover 120 may be collided with or separated from the main body 110.

SUMMARY OF THE INVENTION

It is, therefore, an object of the present invention to provide a vacuum cleaner having a simple locking/releasing structure of a cover and a main body by providing a suction inlet at the main body.

It is another object of the present invention to provide a vacuum cleaner having a cover hinge-coupling structure which allows the cover to be rotated about two different hinge axes, while preventing the cover from being unintentionally closed by itself.

In accordance with an aspect of the present invention, there is provided a vacuum cleaner including: a suction inlet formed at a main body; a cover hinge-coupled to the main body to cover a dust collection chamber defined in the main body; and a locking unit for releasably locking the cover, the locking unit being disposed around the suction inlet.

Preferably, the locking unit includes a pair of locking members disposed at two opposite sides of the suction inlet and a resilient member disposed between the locking members to bias the locking members outward, each locking member having an engagement protrusion projected outward; the cover includes an outer portion and an engagement portion each of which has an approximate U-shape in section, the engagement portion having opposite button portions projected through the outer portion and opposite pressing portions extended from the button portions inside the outer portion, the outer portion having opposite projecting portions which are projected inward from the outer portion to be engaged with the respective engagement protrusions of the locking members.

In accordance with an another aspect of the present invention, there is provided a vacuum cleaner including: a main body in which a dust collection chamber is defined; a cover for covering the dust collection chamber; and a pivot link for rotatably connecting the cover and the main body, wherein the cover and the main body are rotatable about different two hinge axes.

Preferably, the pivot link includes a cover coupling portion and a main body coupling portion extended from the cover coupling portion in an approximate L-shape; the cover is hinge-coupled to the cover coupling portion of the pivot link to be rotatable about one of the hinge axes; and the main body coupling portion of the pivot link is hinge-coupled to the main body to be rotatable about the other hinge axis.

Preferably, the main body coupling portion has a hinge shaft provided at an end portion thereof, the hinge shaft of the main body coupling portion being hinge-coupled to a coupling recess provided at the main body.

Preferably, the coupling recess of the main body has wave-shape side surfaces such that side surfaces of the main body coupling portion of the pivot link are friction coupled to the wave-shape side surfaces of the coupling recess.

In accordance with a further another aspect of the present invention, there is provided a vacuum cleaner including: a suction inlet provided at a main body; a cover hinge-coupled to the main body to cover a dust collection chamber included in the main body; a locking unit for releasably locking the cover, the locking unit being disposed around the suction inlet; and a pivot link for rotatably connecting the cover and the main body, wherein the cover and the main body are rotatable about different two hinge axes.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, preferred embodiments of the present invention will be described with reference to FIGS. 2 to 4B.

Figure 1:
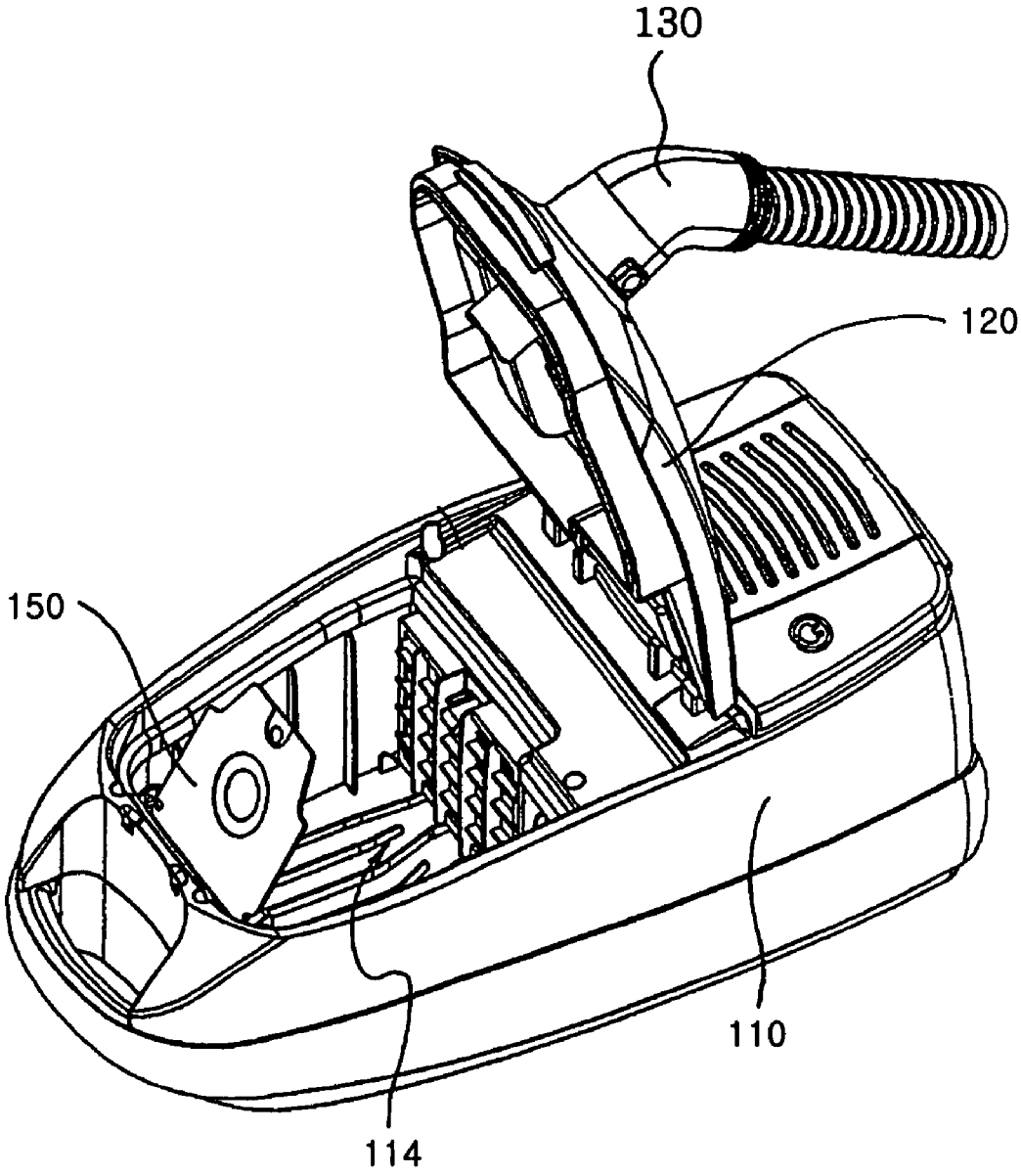
FIG. 1 (PRIOR ART)
FIG. 1 is a perspective view of a conventional vacuum cleaner with its cover opened.
Figure 2A:
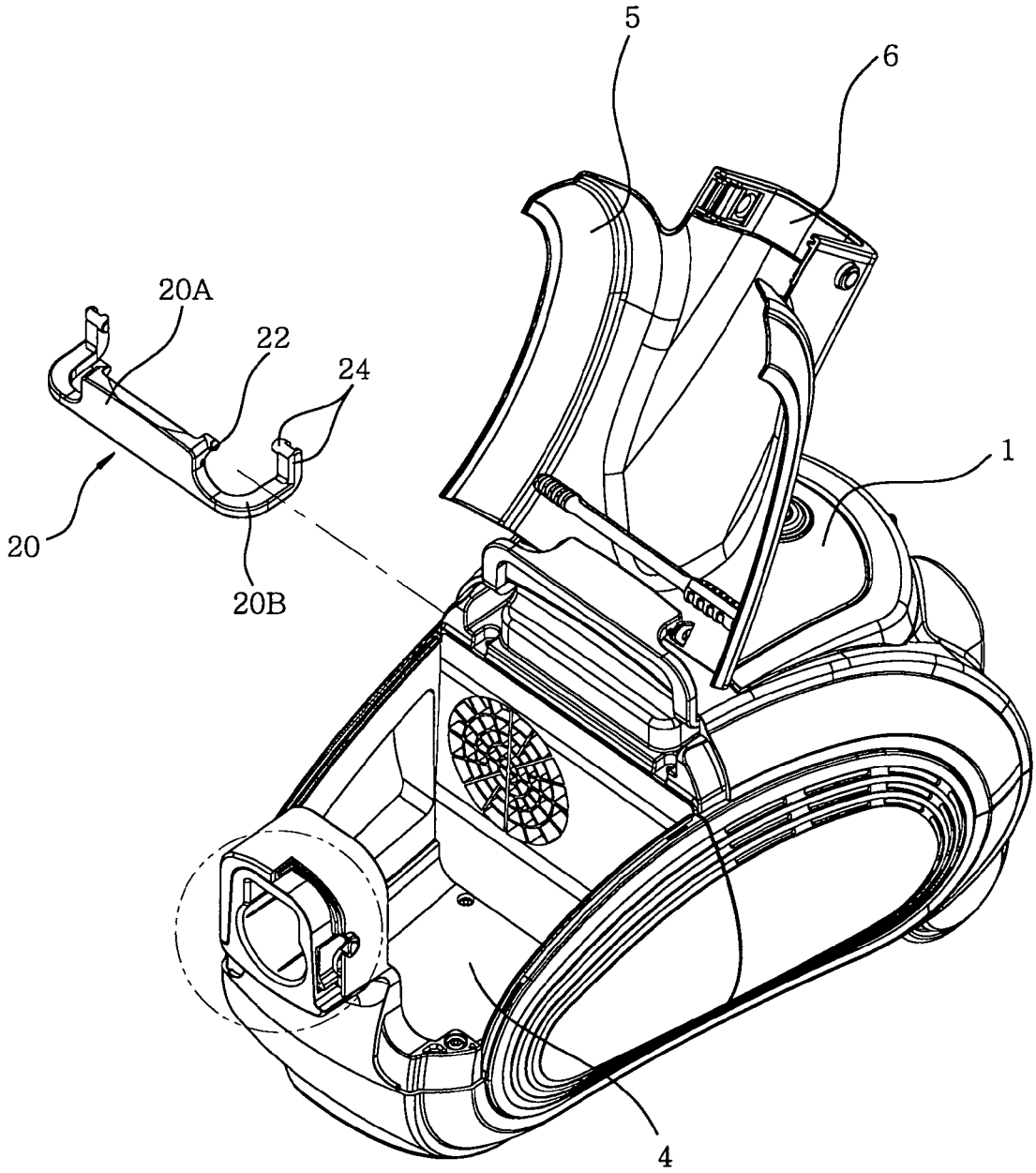
FIG. 2A sets forth a perspective view of a vacuum cleaner in accordance with the present invention, wherein a pivot link is shown separately.

Referring to FIG. 2A, there is illustrated a vacuum cleaner in accordance with the present invention, wherein a cover 5 of the vacuum cleaner is opened and a pivot link 20 for connecting a main body 1 and the cover 5 of the vacuum cleaner is shown separately.

A suction inlet 2 to which an air suction tube (not shown) is connected is disposed in a front region of the main body 1 of the vacuum cleaner, and a dust collection chamber 4 is provided behind the suction inlet 2 in order to accommodate therein a dust bag or a cyclonic dust collection device.

The cover 5 is hinge-coupled to the main body 1 via the pivot link 20 to cover the dust collection chamber 4. The dust bag or the cyclonic dust collection device can be removed from the main body 1 after opening the cover 5, as shown in FIG. 2A.

Further, locking members 30 are installed at outer peripheral portions of the suction inlet 2 to keep the cover 5 locked in position while covering the dust collection chamber 4.

Figure 2B:
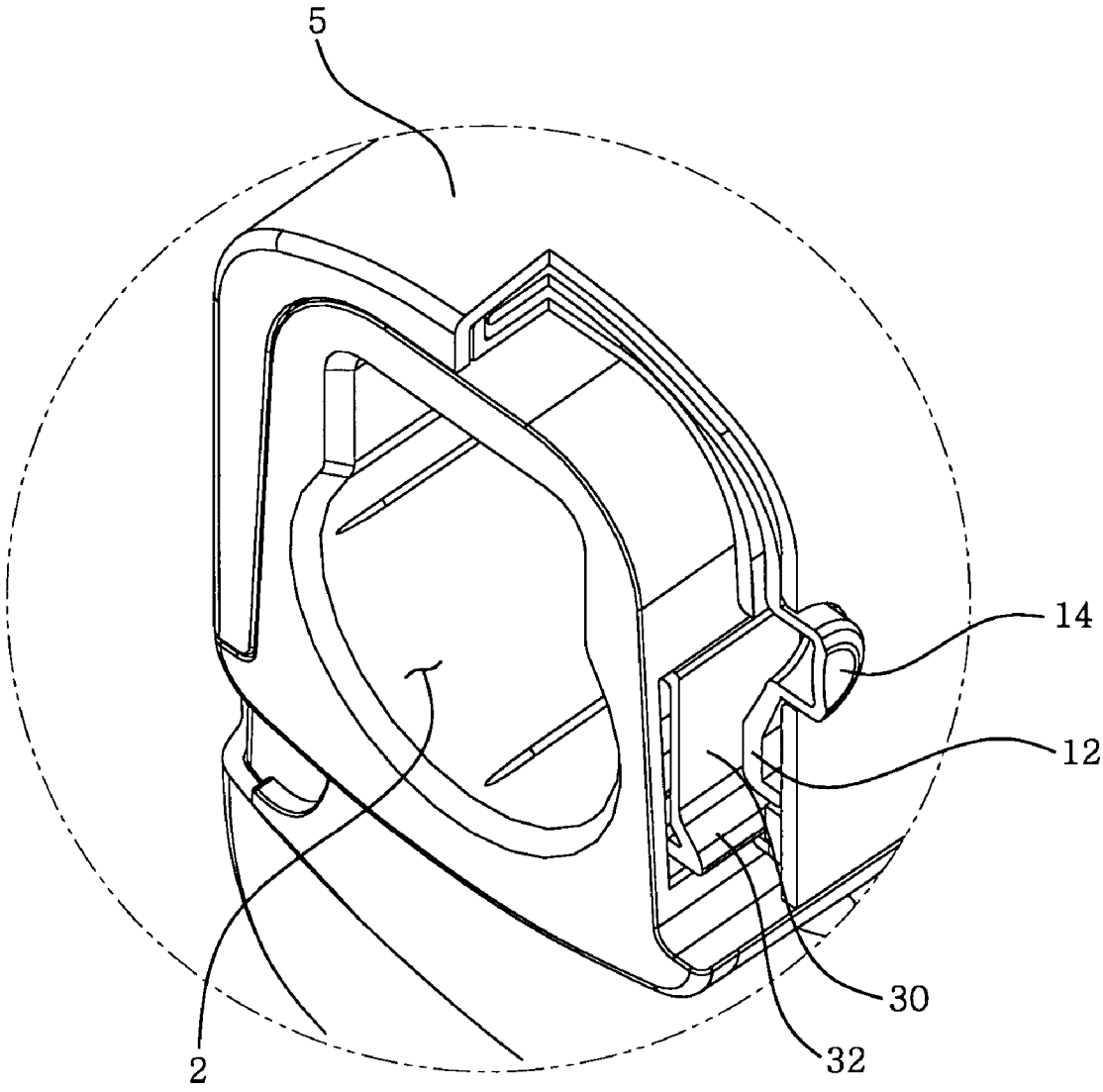
FIG. 2B is a partially cut-away perspective view of a locking member and a cover locked together.
Figure 3:
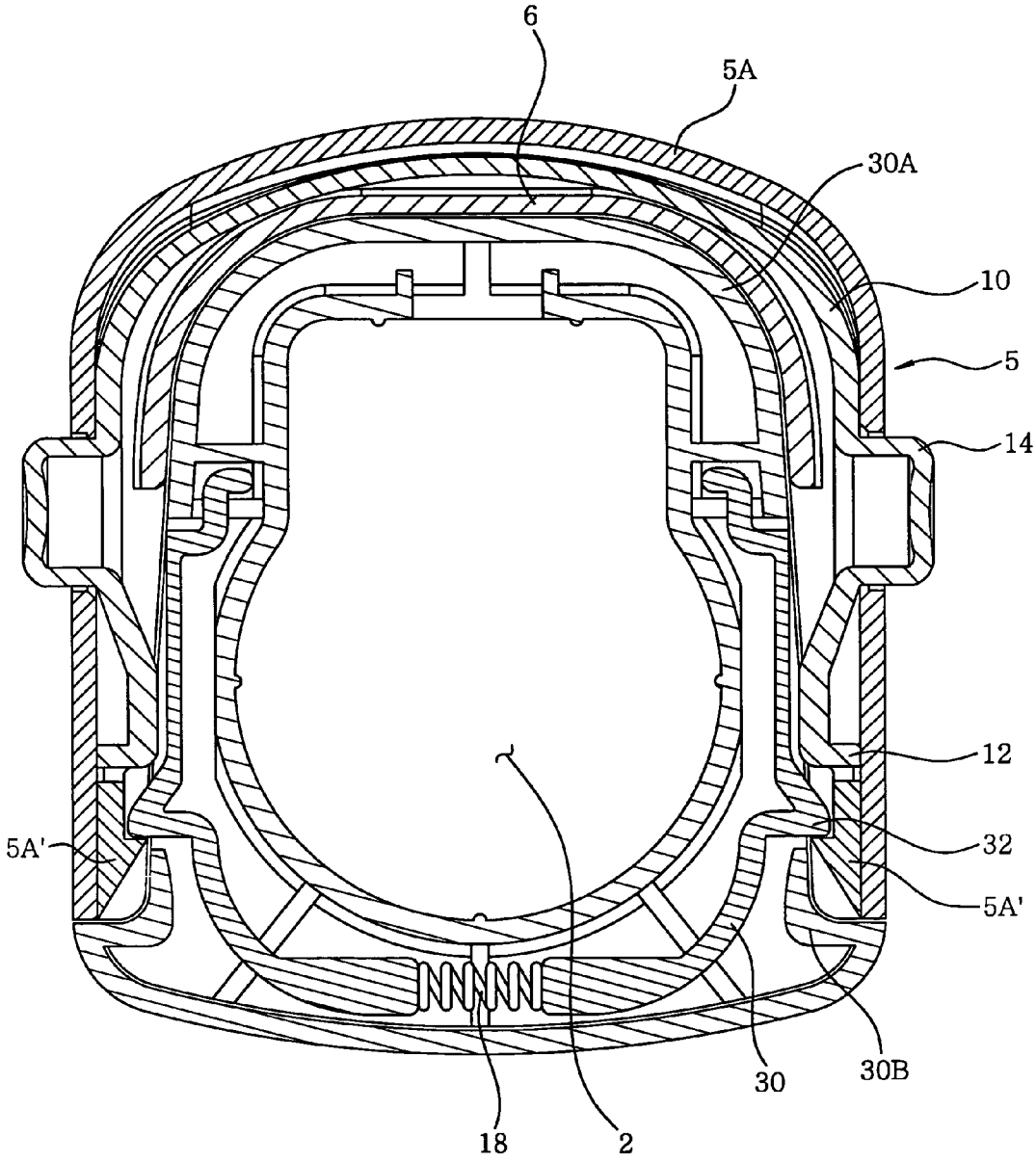
FIG. 3 provides a cross sectional view of a cover locking/releasing structure in accordance with the present invention.

Hereinafter, structures of the cover 5 and the locking members 30 and their locking/releasing operations will be described with reference to FIGS. 2B to 3. FIG. 2B is a partially cut-away perspective view of the locking member 30 and the cover 5 locked together and FIG. 3 sets forth a cross sectional view showing a locked state of the cover 5 and the locking members 30.

The locking members 30 are disposed at two opposite sides of the suction inlet 2 and each locking member 30 has an engagement protrusion 32 at an approximately central portion thereof. The upper end of each locking member 30 is supported by a locking member support 30A such that it is pivotable about the upper end thereof, and a resilient member such as a compression spring 18 is interposed between the lower ends of both locking members 30. The compression spring 18 serves to bias the locking members 30 outward against stoppers 30B, respectively.

The cover 5 includes a sealing portion 6 brought into contact with the outer peripheral surface of the locking member support 30A; an outer portion 5A having protruding portions 5A' projected inward from two opposite lower ends thereof; and an engagement member 10 interposed between the sealing portion 6 and the outer portion 5A. The sealing portion 6, the outer portion 5A and the engagement member 10 have an approximate U-shape in section.

The engagement member 10 has at both sides thereof button portions 14 projected outward through openings of the outer portion 5A and pressing portions 12 extended downward from the button portions 14 to be located inside the outer portion 5A.

In case the cover 5 is closed to cover the dust collection chamber 4, the protruding portions 5A' of the outer portion 5A serve to urge the respective engagement protrusions 32 of the locking members 30, whereby the engagement members 30 are inwardly moved against a bias force of the compression spring 18. Then, the protruding portions 5A' at the outer portion 5A of the cover 5 are moved downward beyond the engagement protrusions 32 to contact the stoppers 30B located below the engagement protrusions 30. At that time, the locking members 30 are moved outward again by the bias force of the compression spring 18, so that the engagement protrusions 32 are engaged with the respective protruding portions 5A' to prevent the cover 5 from being lifted. By such a locking mechanism, the cover 5 is locked by the locking members 30.

In case of lifting the cover 5 to open the dust collection chamber 4, when a user pushes the button portions 14 which are protruded outwardly through the outer portion 5A of the case 5, the pressing portions 12 integrated with the respective button portions 14 are moved inward to press the locking members 30, respectively. At that time, the locking members 30 are moved inward against the bias force of the compression spring 18, the engagement of the engagement protrusions 32 and the protruding portions 5A' is released, allowing the cover 5 to be movable in an upward direction. In this state, when the user lifts the cover 5 upward, the dust collection chamber 4 is opened.

Figure 4A:
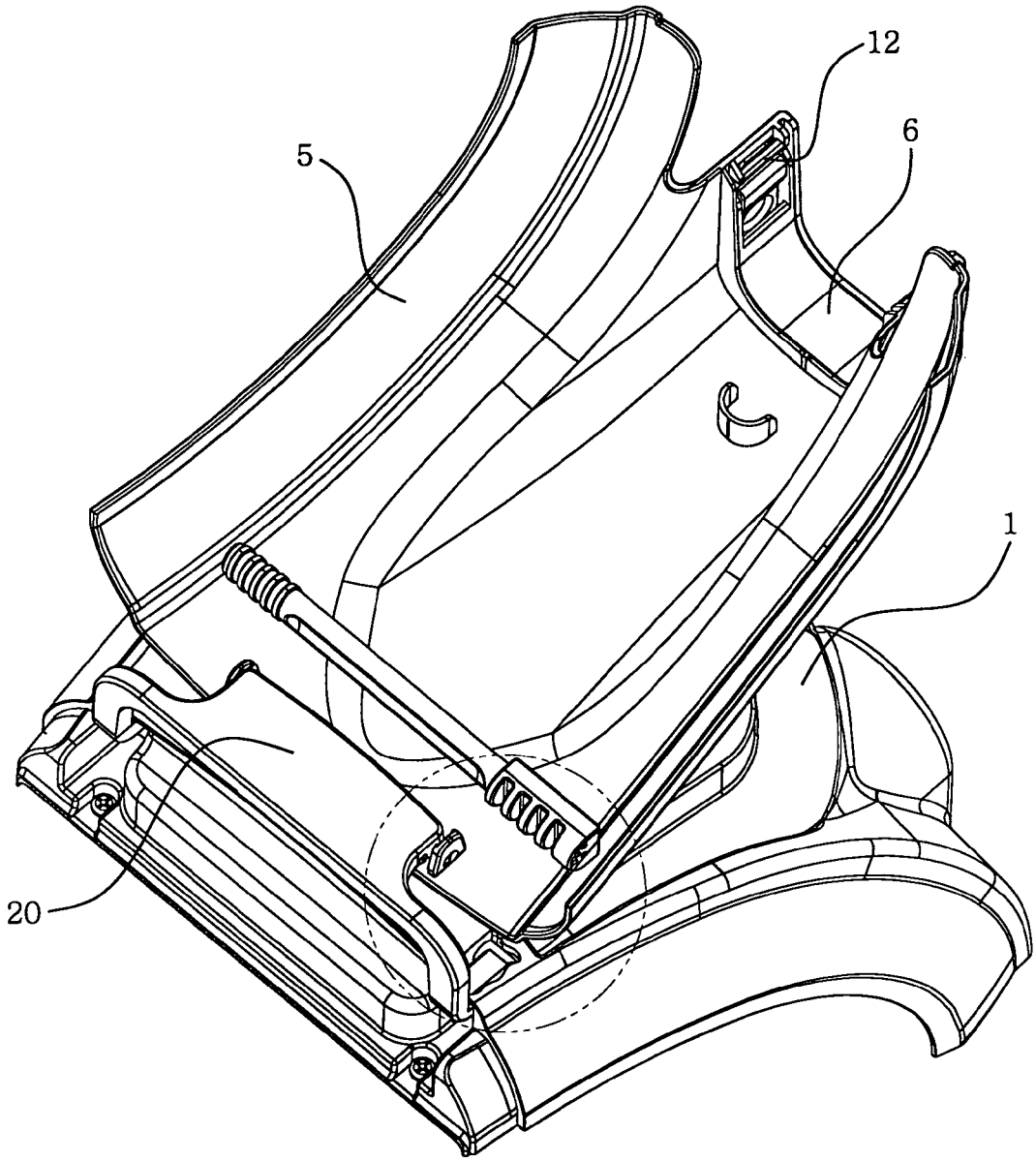
FIG. 4A shows a cover and a main body hinge-coupled to each other.
Figure 4B:
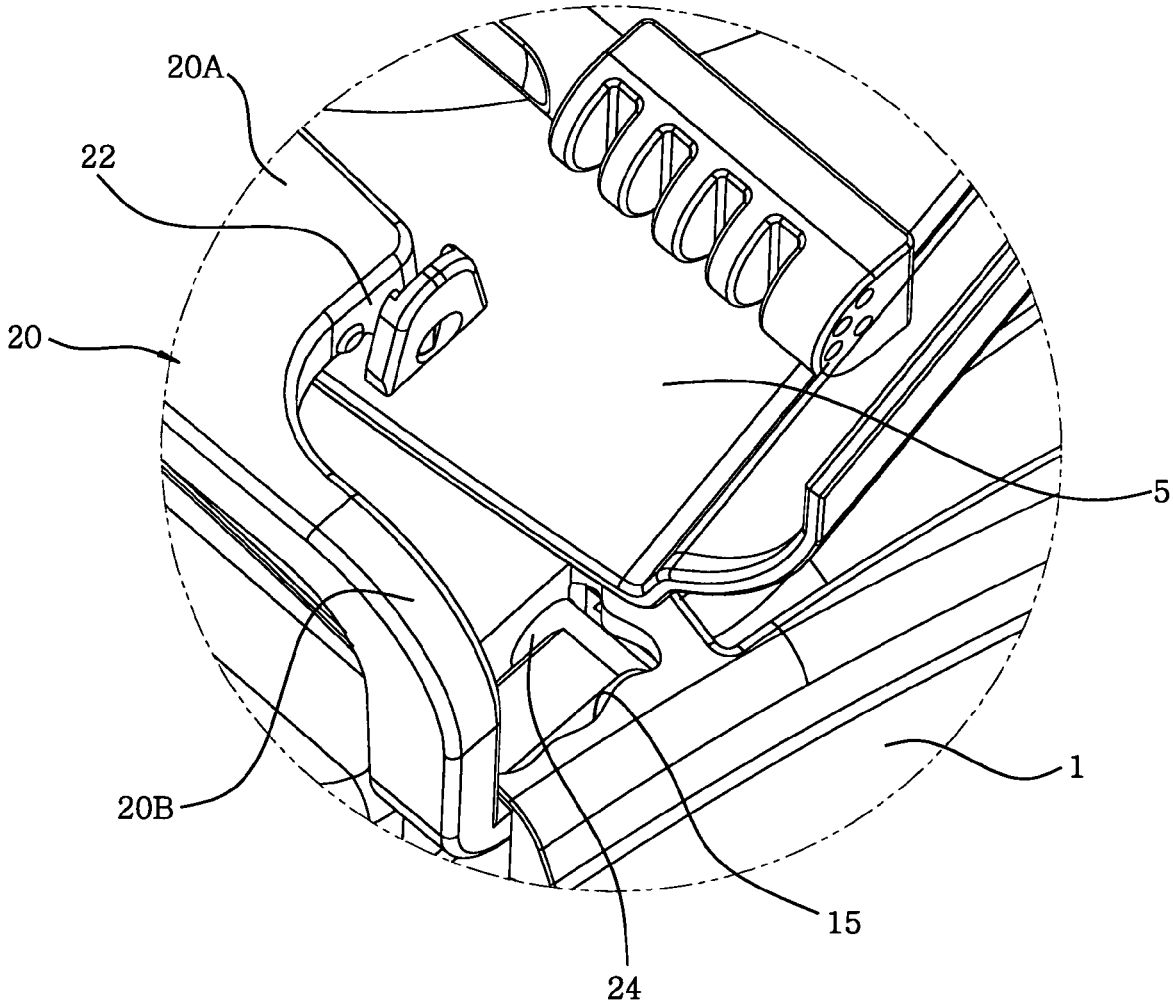
FIG. 4B depicts a partial enlarged view of a portion in FIG. 4A.

A connection structure of the cover 5 and the main body 1 of the vacuum cleaner in accordance with the present invention will now be described with reference to FIGS. 4A and 4B. FIG. 4A is a partial perspective view of a coupling portion of the cover 5 and the main body 1 of the vacuum cleaner and FIG. 4B provides a partial enlarged view thereof.

The cover 5 is hinge-coupled to cover hinge shafts 22 provided at two opposite upper ends of a cover coupling portion 20A of the approximately L-shaped pivot link 20 (see FIG. 2A). Main body coupling portions 20B are extended from the cover coupling portion 20A in an approximate L-shape. Further, a main body hinge shaft 24 is provided at an end portion of each of the main body coupling portions 20B. The main body hinge shafts 24 are hinge-coupled to coupling recesses 15 formed at the main body 1, respectively. Two opposite side surfaces of each of the coupling recesses of the main body 1 are formed in a wave-shape. By allowing both side surfaces of each of the main body coupling portions 20B to be friction coupled to the wave-shaped surfaces of the corresponding coupling recess 15, the cover 5 is prevented from being unintentionally closed due to its weight in an open mode.

In case of lifting the cover 5 to open the dust collection chamber 4, the cover 5 is pivoted by the combination of a rotation of the cover 5 about the cover hinge shafts 22 of the cover coupling portion 20A and a rotation of the main body coupling portions 20B about the main body hinge shafts 24. For example, the cover 5 is completely opened in such a way that the cover 5 is rotated about the cover hinge shafts 22 of the cover coupling portion 20A of the pivot link 20 while or after the pivot link 20 is rotated about the cover hinge shafts 22 of the cover coupling portion 20A. In this way, the cover 5 is opened in multi-stages by two different hinge axes of the hinge shafts 22 and 24.

As described above, according to the present invention, there is provided an inventive cover locking/releasing structure and a cover hinge-coupling structure. The locking/releasing structure of the main body and the cover is simplified, and the cover can be prevented from being unintentionally closed due to its weight in an open mode.

While the invention has been shown and described with respect to the preferred embodiment, it will be understood by those skilled in the art that various changes and modification may be made without departing from the spirit and scope of the present invention as defined in the following claims.

What is claimed is:

1. A vacuum cleaner comprising:

a suction inlet formed at a main body;

a cover hinge-coupled to the main body to cover a dust collection chamber defined in the main body; and a locking unit for releasably locking the cover, the locking unit being disposed around the suction inlet, wherein the locking unit includes a pair of locking members disposed at two opposite sides of the suction inlet and a resilient member disposed between the locking members to bias the locking members outward, each locking member having an engagement protrusion projected outward; the cover includes an outer portion and an engagement portion each of which has an approximate U-shape in section, the engagement portion having at both its sides a pair of button portions projected through the outer portion and a pair of pressing portions extended from the respective button portions inside the outer portion, the outer portion having a pair of projecting portions projected inward from both sides of the outer portion, the projecting portions being engaged with the respective engagement protrusions of the locking members when the cover is closed.

* * * * *